US011674275B2

(12) United States Patent
Tipaldo

(10) Patent No.: US 11,674,275 B2
(45) Date of Patent: Jun. 13, 2023

(54) RETRACTABLE SAFETY MARKER

(71) Applicant: John Tipaldo, Belle Harbor, NY (US)

(72) Inventor: John Tipaldo, Belle Harbor, NY (US)

( * ) Notice: Subject to any disclaimer, the term of this patent is extended or adjusted under 35 U.S.C. 154(b) by 269 days.

(21) Appl. No.: 16/991,332

(22) Filed: Aug. 12, 2020

(65) Prior Publication Data

US 2022/0049440 A1 Feb. 17, 2022

(51) Int. Cl.

| | |
|---|---|
| ***E01F 9/654*** | (2016.01) |
| ***E01F 9/646*** | (2016.01) |
| ***E01F 9/692*** | (2016.01) |
| ***E01F 9/70*** | (2016.01) |

(52) U.S. Cl.

CPC ..... *E01F 9/654* (2016.02); *E01F 9/646* (2016.02); *E01F 9/692* (2016.02); *E01F 9/70* (2016.02)

(58) Field of Classification Search

CPC . E01F 9/654; E01F 9/646; E01F 9/692; E01F 9/70; E01F 9/688; B60Q 7/005

See application file for complete search history.

(56) References Cited

U.S. PATENT DOCUMENTS

| | | | | |
|---|---|---|---|---|
| 425,650 A | | 4/1890 | Bing | |
| 2,235,280 A | * | 3/1941 | Carver | B60Q 7/005 359/872 |
| 2,256,014 A | * | 9/1941 | Carver | B60Q 7/005 248/176.1 |
| 2,525,728 A | * | 10/1950 | Sauer | B60Q 7/00 116/63 P |
| 2,536,177 A | * | 1/1951 | Harkins | B60Q 1/2607 206/573 |
| 2,762,327 A | | 9/1956 | Weig | |
| 2,954,005 A | | 9/1960 | Cioffi et al. | |
| 3,132,624 A | | 5/1964 | Shoemaker, Jr. | |
| 3,256,853 A | * | 6/1966 | Underwood | B60Q 7/005 116/63 P |
| 3,496,904 A | | 2/1970 | Rimkus | |
| 3,520,235 A | | 7/1970 | Palazzolo et al. | |

(Continued)

FOREIGN PATENT DOCUMENTS

| | | |
|---|---|---|
| CN | 103046495 A | 4/2013 |
| CN | 107642051 A | 1/2018 |
| WO | 2013/017120 A2 | 7/2013 |

OTHER PUBLICATIONS

Extended European Search Report from European Patent Application No. 21190854.6 dated Jan. 13, 2022.

*Primary Examiner* — John Fitzgerald
*Assistant Examiner* — Tania Courson
(74) *Attorney, Agent, or Firm* — Dilworth & Barrese, LLP

(57) ABSTRACT

A retractable cylindrical safety marker is provided. The retractable cylindrical safety marker includes a base, having a middle section defining an upper planar surface and two opposing edges; a first end section rotatably attached at an end to one of the opposing edges; and a second end section rotatably attached at an end to the other of the opposing edges, and a vertical riser, having a lower riser having a lower end attached to the first end section and the second end section, the lower riser having a slot extending along its interior surface in the longitudinal direction; and at least one upper riser concentrically positioned within the lower riser, the upper riser having a tab positioned on an outer surface thereof, the tab being mateable with the slot and configured to permit the tab to translate along the slot.

24 Claims, 16 Drawing Sheets

(56) References Cited

U.S. PATENT DOCUMENTS

| | | | | |
|---|---|---|---|---|
| 3,742,897 | A * | 7/1973 | Meek | B60Q 7/005 116/63 P |
| 4,006,702 | A | 2/1977 | St. Cyr | |
| 4,197,807 | A | 4/1980 | Campbell | |
| 4,256,050 | A | 3/1981 | Barnard | |
| 4,462,145 | A | 7/1984 | Schulze | |
| 4,466,376 | A | 8/1984 | Wells | |
| 4,489,306 | A | 12/1984 | Scolari | |
| 5,287,822 | A | 2/1994 | Anderson | |
| 5,305,705 | A | 4/1994 | Gagliano | |
| 5,775,253 | A * | 7/1998 | Quan | B60Q 7/005 116/63 P |
| 6,508,195 | B1 | 1/2003 | Tipaldo | |
| 6,681,715 | B2 | 1/2004 | Wood | |
| 6,746,337 | B1 | 6/2004 | Tipaldo | |
| 7,258,506 | B2 | 8/2007 | Tipaldo | |
| 7,261,051 | B2 | 8/2007 | Tipaldo | |
| 7,437,845 | B2 * | 10/2008 | Huang | G09F 13/16 116/63 P |
| 7,571,693 | B2 | 8/2009 | Tipaldo | |
| 9,493,919 | B2 * | 11/2016 | Handy | E01F 9/617 |
| 9,689,123 | B2 | 6/2017 | Chi | |
| 10,329,721 | B2 * | 6/2019 | Xie | E01F 9/654 |
| 2002/0062780 | A1 | 5/2002 | Chen | |
| 2006/0127176 | A1 | 6/2006 | Tipaldo | |
| 2018/0058022 | A1 | 3/2018 | Adeleke | |

* cited by examiner

RETRACTABLE SAFETY MARKER

BACKGROUND OF THE INVENTION

The present disclosure relates to a device for alerting motorists to the presence of disabled vehicles or work zone areas. Each year hundreds of motorists are either killed or injured alongside the roadway. Many of these accidents can be prevented if the oncoming motorists have advanced warning of the presence of these disabled vehicles.

Several varieties of traffic warning devices are known and as described in the following U.S. Pat. Nos. 7,571,693, 6,508,195, 6,681,715, 2,954,005, 3,496,904, 4,006,702, 4,197,807, 4,256,50, 2,762,327, 3,132,624, 3,520,235, 4,462,145, 4,466,376 and 5,287,822.

Over the years there have been many attempts to provide a retractable or collapsible traffic cone. Designs have spanned from sleeves of varying diameters and tapers, which when extended fit into one another and form a cone shaped marker: see for example U.S. Pat. Nos. 2,954,005 and 3,496,904. These devices require many separate risers to provide a proper traffic control device height while achieving compact storage. These risers increase costs and decrease stability of the unit. In addition, the multiple layers increase the manufacturing cost of the unit when applying reflective sheets consistent with nationally accepted traffic device design standards. Also, the fewer the number of risers used in constructing the device, the reduced efficiency in storage.

Another variation of the concept is found in U.S. Pat. No. 2,762,327 where the device is inflatable and is attached to a solid base and filled with air when ready for use. Other designs have employed coils or springs as a means of displaying the traffic control device, some of which are described in U.S. Pat. Nos. 4,006,702, 4,256,050, 4,197,807, 4,256,050 and 5,305,705. The need for coils and springs have an economic disadvantage in material costs and require an additional cloth or plastic covering over the spring or coil which necessitates the use of flexible reflective material which has increased cost compared to standard reflective sheeting.

Other designs have employed the use of springs and a flexible membrane, for example in U.S. Pat. No. 3,132,624, and a two-piece center support member. U.S. Pat. No. 3,520,235 describes a device that requires assembly prior to use and employs a two-piece center support pole. The present invention eliminates the need for any assembly prior to implementation, which in an emergency may become problematic.

In other designs three and four sided panel fan shaped members, for example in U.S. Pat. Nos. 4,466,376 and 4,462,145, are employed to form upright three and four sided triangles, respectively. These devices have a disadvantage in not having a self-contained base for support in high wind conditions and require a large surface area to store. They also require intricate installation which in an emergency may also become problematic.

While this has long been recognized as a traffic safety problem many needless deaths and injuries continue to happen every year. The following disclosure solves these and many other problems existing in the prior art safety marker designs.

SUMMARY OF THE INVENTION

Accordingly, the present invention has been made to solve at least the above-mentioned problems occurring in the prior art, and an object of the present invention is to provide a retractable cylindrical safety marker.

To accomplish the above and other objects, there is provided a retractable cylindrical safety marker that includes a base, comprising: a middle section defining an upper planar surface and two opposing edges; a first end section rotatably attached at an end to one of the opposing edges; and a second end section rotatably attached at an end to the other of the opposing edges, wherein the base has a closed configuration when the end sections are folded near to the middle section, and wherein the base has an opened configuration when the end sections are folded away from the middle section, and a vertical riser, comprising: a lower riser having a lower end attached to the first end section and the second end section, the lower riser having a slot extending along its interior surface in the longitudinal direction; and at least one upper riser concentrically positioned within the lower riser, the upper riser having a tab positioned on an outer surface thereof, the tab being mateable with the slot and configured to permit the tab to translate along the slot, wherein each riser is cylindrical in shape, wherein the risers are moveable between a flattened configuration and an expanded configuration perpendicular to a longitudinal axis of the vertical riser, wherein the risers are moveable between a retracted configuration and an extended configuration along the longitudinal axis of the vertical riser.

Also provided is a retractable cylindrical safety marker that includes a base, comprising a lower portion comprised of a flat bottom section; a first and a second end sections, each end section having a bottom with no top, two short sides and a long side, the short sides of the first base support foldable at a first position about the middle section, and the short sides of the second base support foldable at a second position about the middle section; a lower riser of the least two collapsible hollow vertical risers having a plurality of rotatable connections between the lower cylindrical riser the at least two collapsible hollow vertical cylindrical risers and the first and the second end sections of the base support; and an upper riser of the least two collapsible hollow vertical cylindrical risers being extendable from the lower riser of the least two collapsible hollow vertical risers that fit within each other and are connected to each other through a series of tabs and slots that allow for vertical motion between the successive vertical cylindrical risers, an extrusion on the slots of the vertical cylindrical risers that prohibit the successive risers from being pulled through each other, wherein when the end sections of the base support are in an unfolded open position, the at least two collapsible hollow vertical cylindrical risers are maintained in the expanded position due to a pulling force of the base supports on the lower riser of the at least two collapsible hollow vertical cylindrical risers through the connections and when the end sections of the base support are in a folded closed position, the at least two collapsible hollow vertical cylindrical risers are maintained in the collapsed position due to a pushing force of the base supports on the least two collapsible hollow vertical cylindrical risers.

BRIEF DESCRIPTION OF THE DRAWINGS

The above another objects, features and advantages of the present invention will be more apparent from the following detailed description taken in conjunction with the accompanying drawings in which.

DETAILED DESCRIPTION OF THE PREFERRED EMBODIMENTS

Figure 1:
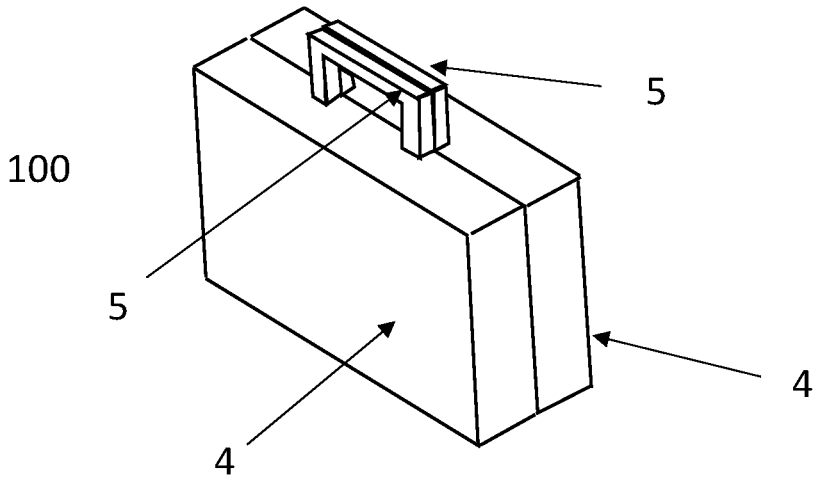
FIG. 1 is a perspective view of the retractable cylindrical safety marker according to the present disclosure in the closed and retracted position.

Hereinafter, preferred embodiments of the present invention will be described in detail with reference to the accompanying drawings. Note that the same or similar components in drawings are designed by the same reference numerals as far as possible although they are shown in different drawings. In the following description of known function and configurations incorporated herein will be omitted when it may make the subject matter of the present disclosure rather unclear.

Reference will now be made to the drawings in which various elements of the present invention will be given numerical designations. In its present form the invention consists of several distinct elements. These elements when combined as described within will allow one of ordinary skill in the art to make and use the present invention.

Current methods of enhancing motorist awareness of safety hazards include flares, solid plastic cones and collapsible or spring cones. The retractable cylindrical safety marker according to the present disclosure is designed to eliminate current difficulties encountered with use of existing road safety devices.

With roadside flares there is the inherent short fall that they only last a given period of time and are not re-useable. In addition, they are usually only several inches above the roadway surface and may present difficulty in operating. Solid plastic cones are easy to place along the roadway, however unless they are properly weighted they may be displaced due to strong winds. In addition, the larger the cone the more storage space that is required. This is a disadvantage especially in smaller passenger vehicles and therefore reduce their attractiveness of use.

In recent years, several collapsible or spring cones have been introduced into the marketplace. In addition, when compared to the designs that require springs, e.g., U.S. Pat. No. 5,305,705, the retractable cylindrical safety marker 100 is totally self-contained and does not require any additional locking mechanism when storing. The reduced storage space significantly increases the attractiveness of the retractable cylindrical safety marker 100, especially in emergency response vehicles where space is at a premium.

U.S. Pat. Nos. 6,508,195 and 7,571,693 teach the use of a rotating base support in which in which retractable arms are attached. The end pieces of the base support go from a closed to open position when rotated about the middle section of the base support.

U.S. Pat. No. 7,571,693 also introduces the use of flexible hinges on vertical risers that are described as rectangular or trapezoidal shaped where the top and bottom sides are open. The vertical risers are designed to fit within each other and are designed with flexible hinges extending their entire length. U.S. Pat. No. 7,571,693 also introduces the use of a single retractable arm which is attached to the middle portion of the base support and uses an upper linkage that is affixed to upper vertical riser. Therefore, when the retractable arm is expanded by use of the handle, the vertical riser is lifted through the linkage between the upper vertical riser and the retractable arm.

U.S. Pat. No. 7,571,693, introduces the use of a separate retractable arm as a means of expanding the series of vertical risers when the risers are in the retracted position is introduced. This is partially necessitated since the inside portions of the consecutive risers do not align flush against each other in a vertical manner they are tapered. Therefore, when lifting the series of vertical risers from the retracted to the expanded position without the retractable arm and associated linkage there is a degree of non-stability and wobble between the successive risers. If the tapers on the vertical risers are steep enough the device might not function properly without the retractable arm.

The retractable cylindrical safety marker 100 eliminates the necessity of the retractable arm and associated upper linkage as taught in U.S. Pat. No. 7,751,693 as the vertical risers are cylindrical in shape.

In the retractable cylindrical safety marker according to the present disclosure the vertical risers are cylindrical in shape with flexible hinges and contain a series of interior slots and exterior tabs that allow for the series of vertical rises to be extended or retracted without the use of a separate retractable arm and associated linkage with the upper riser. The risers are described herein as cylindrical, but can have cross sectional shapes such as circles, ovals, diamonds, squares, rectangles, etc.

In addition, the retractable cylindrical safety marker according to the present disclosure teaches the use of series of flexible connectors that are designed to be affixed to a series of protruding tabs on the base support allowing for a flexible range of motion between the lower riser and the base support when the base support is changed from the open to the closed position.

U.S. Pat. No. 7,751,693 teaches a combination of lower linkages and ball-in-socket type as a means of opening the vertical risers through their flexible hinges when the base support goes from a closed to an open position. The retractable cylindrical safety marker according to the present disclosure eliminates the need for these mechanisms without sacrificing any functional use.

The retractable cylindrical safety marker has been designed to deploy easily, store compactly, withstand prevailing winds, and be economical.

Figure 2:
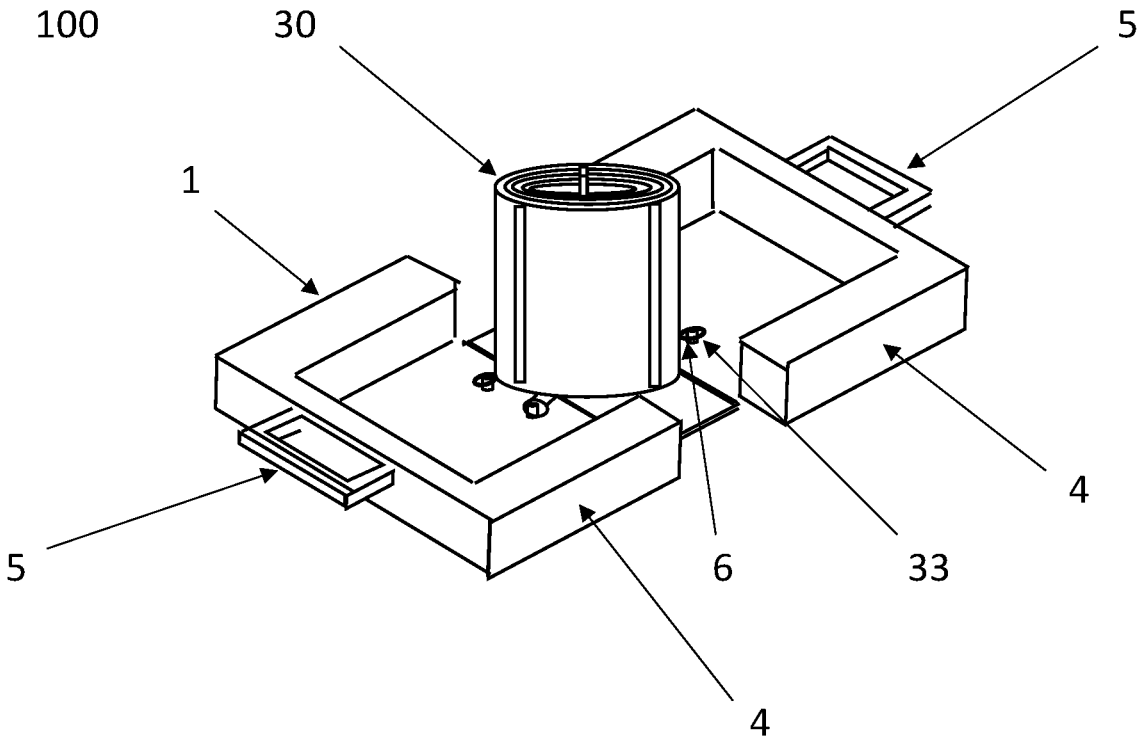
FIG. 2 is a perspective view of the retractable cylindrical safety marker according to the present disclosure in the open and retracted position.
Figure 3:
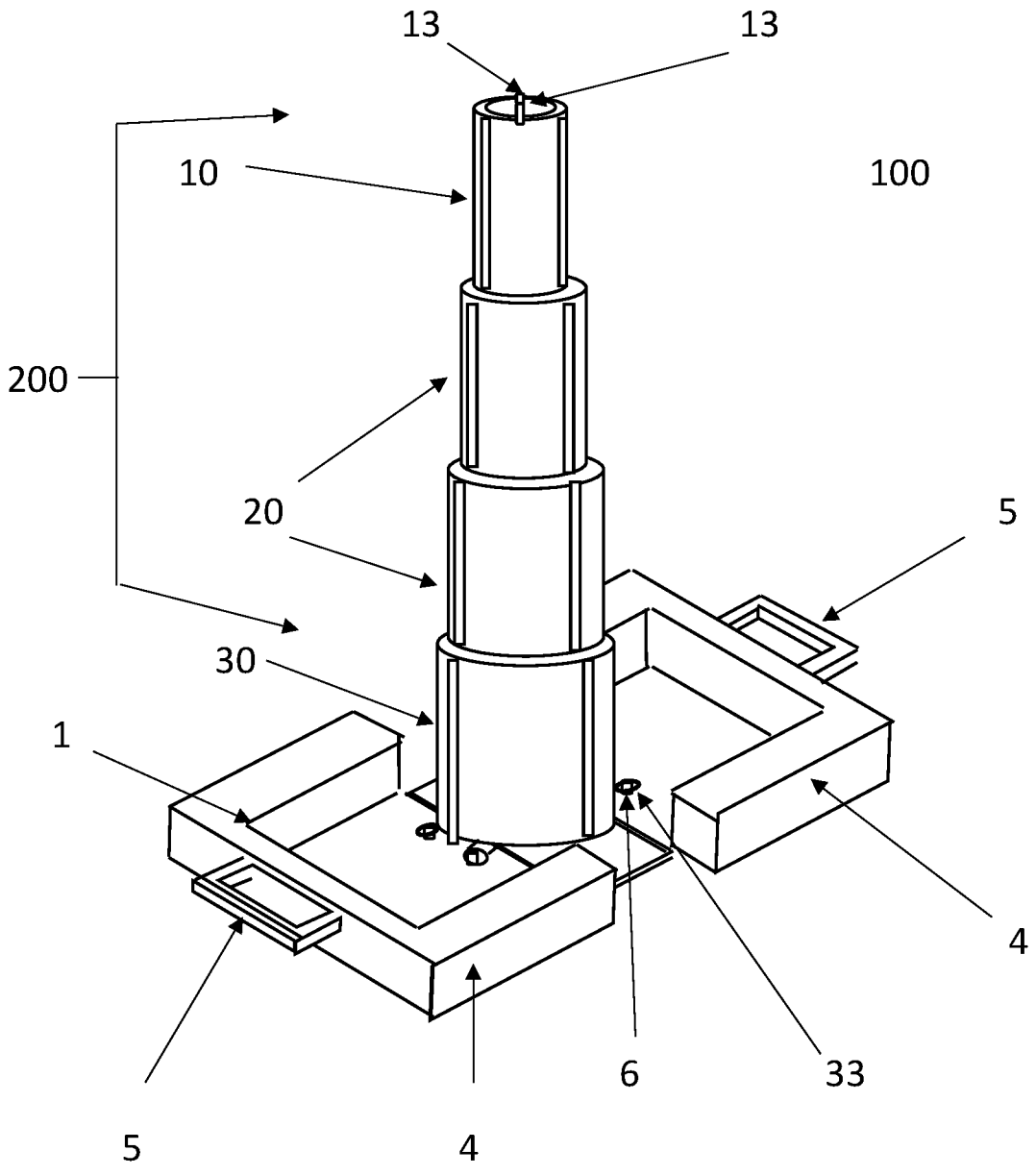
FIG. 3 is a perspective view of the retractable cylindrical safety marker according to the present disclosure in the open and expanded position.

FIG. 1 illustrates the retractable cylindrical safety marker 100 according to the present application in the closed and retracted position, illustrating the base support 1 having two end sections 4. FIG. 2 illustrates the retractable cylindrical safety marker 100 according to the present application in the open and retracted position, illustrating the base support 1 and lower vertical riser 30. FIG. 3 illustrates the retractable cylindrical safety marker 100 according to the present application in the open and expanded configuration, illustrating the base support 1 along with lower riser 30, middle risers 20 and the upper riser 10 in the fully extended position. The base support 1 is configured as a case that can open and close, and provides space in its interior when in the closed position.

The retractable cylindrical safety marker 100 includes a base support 1. The base support 1 operates in a similar fashion as the base supports disclosed in U.S. Pat. Nos. 6,508,195 and 7,571,693, the contents of which are incorporated herein by reference.

In the retractable cylindrical safety marker 100 of the present application the base support 1 is comprised of three sections, i.e., a middle section 2 and two end sections 4. The middle section 2 is connected by a flexible member to the two end sections 4. Each of the two end sections 4 of the base support 1 include at least one vertical protruding tab 6; more than one tab 6 can be utilized for proper functioning.

The base support 1 is intended to provide the necessary weight to ensure that the device is not displaced under reasonable wind loads. The two end sections 4 of the base support 1 include the vertical protruding tabs 6. The end sections 4 are primarily a rectangular shaped type box with the top end and one of the sides open. The two end sections 4 of the base support 1 are affixed to a middle section 2 by a series of flexible members 3. The flexible members 3 allow the two base supports 4 to rotate from a horizontal position to a vertical position adjacent to each other. Each of the two ends 4 of the base support 1 contain a handle 5.

The retractable cylindrical safety marker 100 also includes a vertical riser 200 similar in function to that described in U.S. Pat. No. 7,571,673. The vertical riser 200 in the present disclosure is comprised of an upper riser 10, one or more middle risers 20, and a lower riser 30. The lower riser 30 is connected to the two end sections 4 of the base support 1 by a series of flexible connectors 33 that are attached to the vertical protruding tabs 6 of the two end sections 4 of the base support 1. Each of the vertical 10/20/30 are cylindrical in shape.

Figure 26:
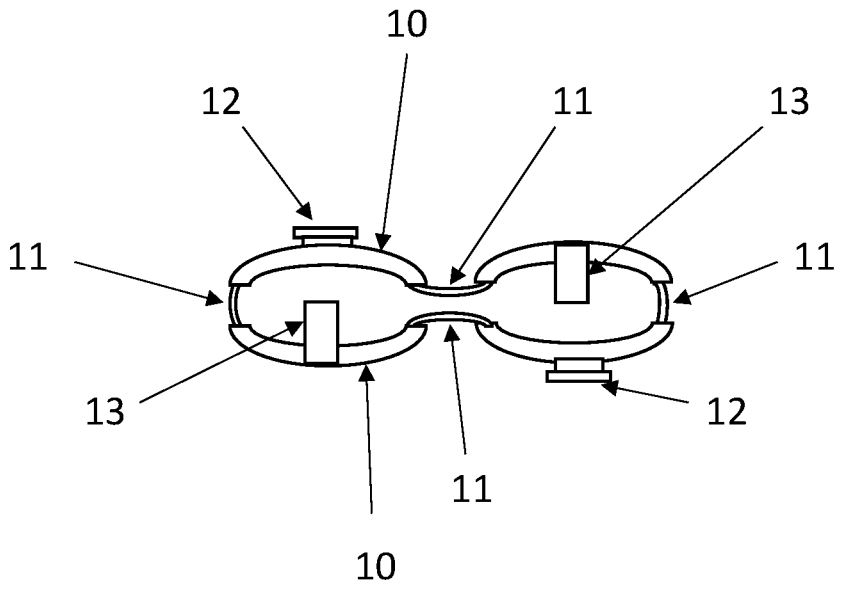
FIG. 26 is a top view of the upper riser of the retractable cylindrical safety marker when in a collapsed position according to the present disclosure.
Figure 27:
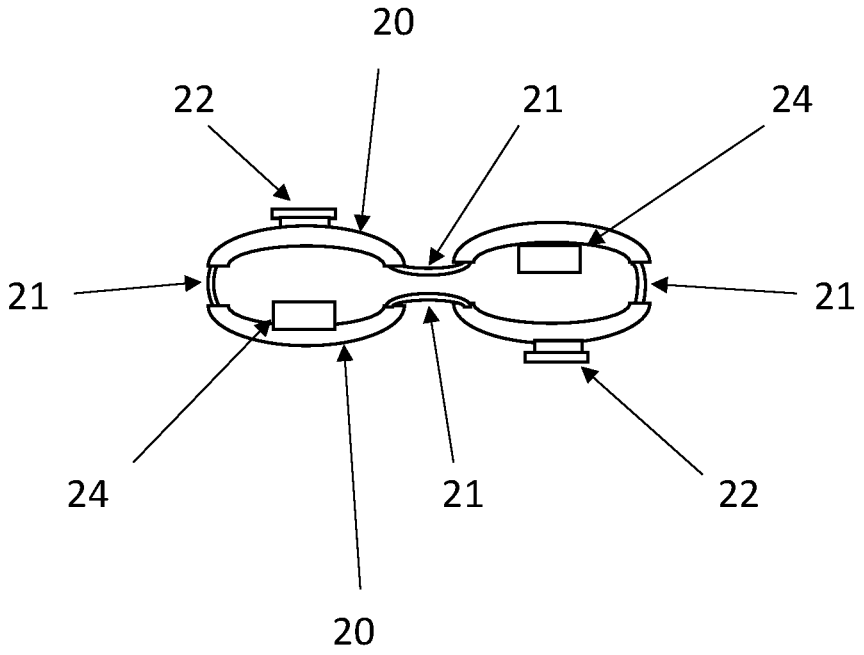
FIG. 27 is a top view of the middle riser of the retractable cylindrical safety marker when in a collapsed position according to the present disclosure.
Figure 28:
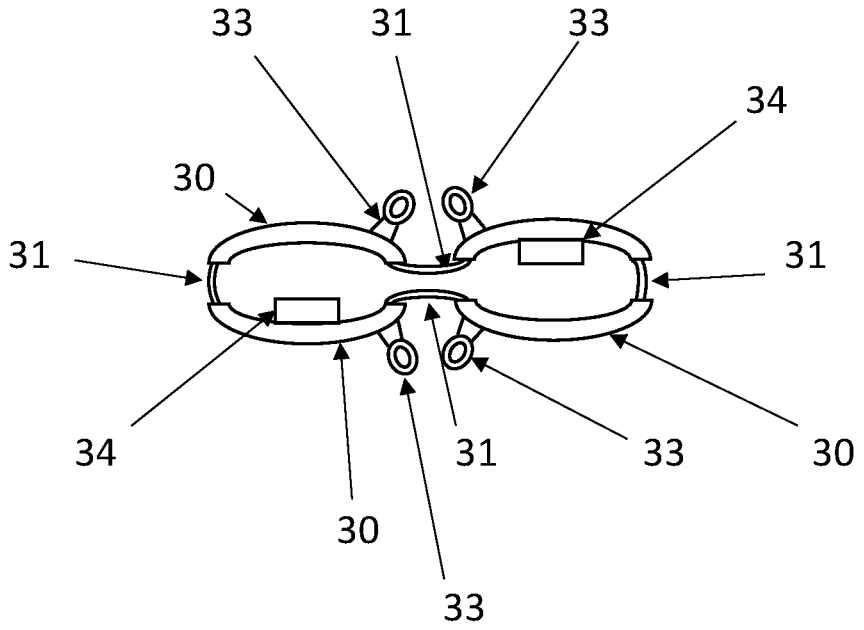
FIG. 28 is a top view of the lower riser of the retractable cylindrical safety marker when in a collapsed position according to the present disclosure.
Figure 29:
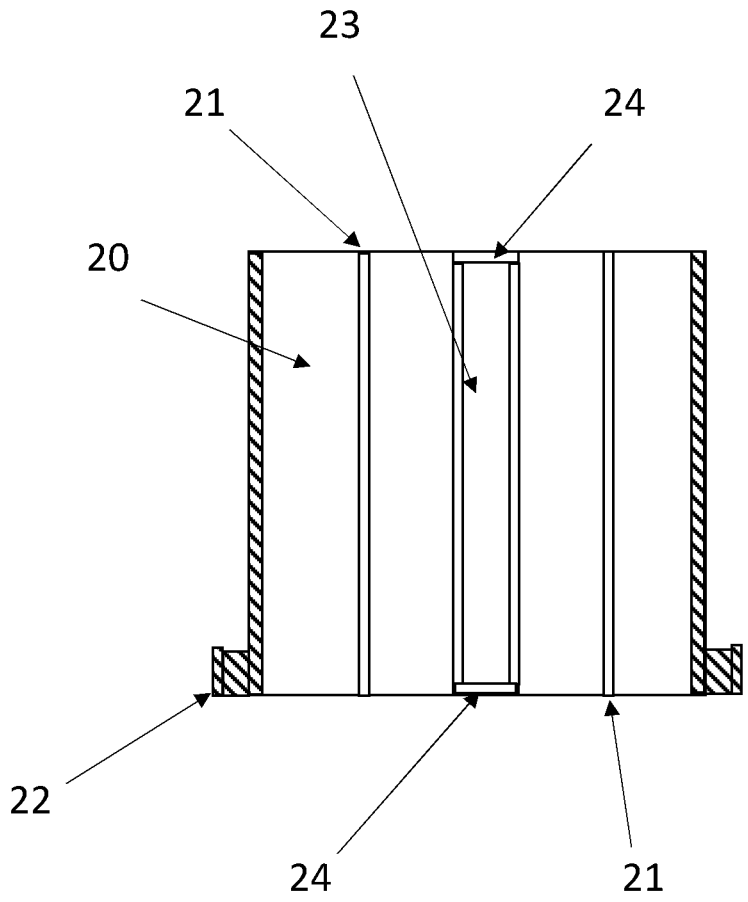
FIG. 29 is an enlarged view of a portion of FIG. 23.

As disclosed in U.S. Pat. No. 7,571,673, the series of vertical risers 10/20/30 are designed with a series of hinges 11/21/31 that extend the entire vertical length of an individual riser component. As with U.S. Pat. No. 7,571,673, this design allows for the vertical risers 200 to be able to change shape, i.e., flatten along its vertical length, when pressure is applied. The series of vertical risers 10/20/30 flattened along a vertical length are illustrated in FIGS. 26-28.

Figure 4:
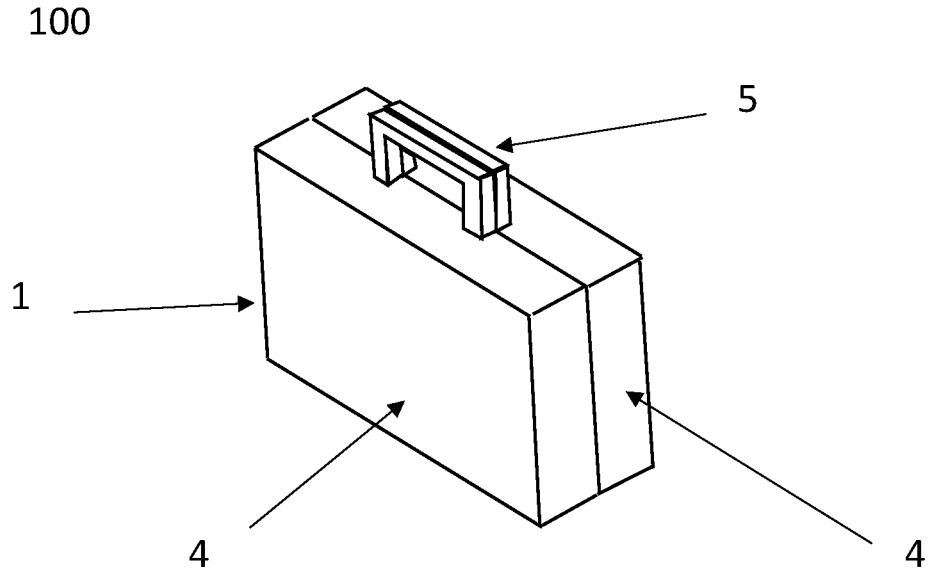
FIG. 4 is a perspective view of the retractable cylindrical safety marker according to the present disclosure in the closed and retracted position.
Figure 5:
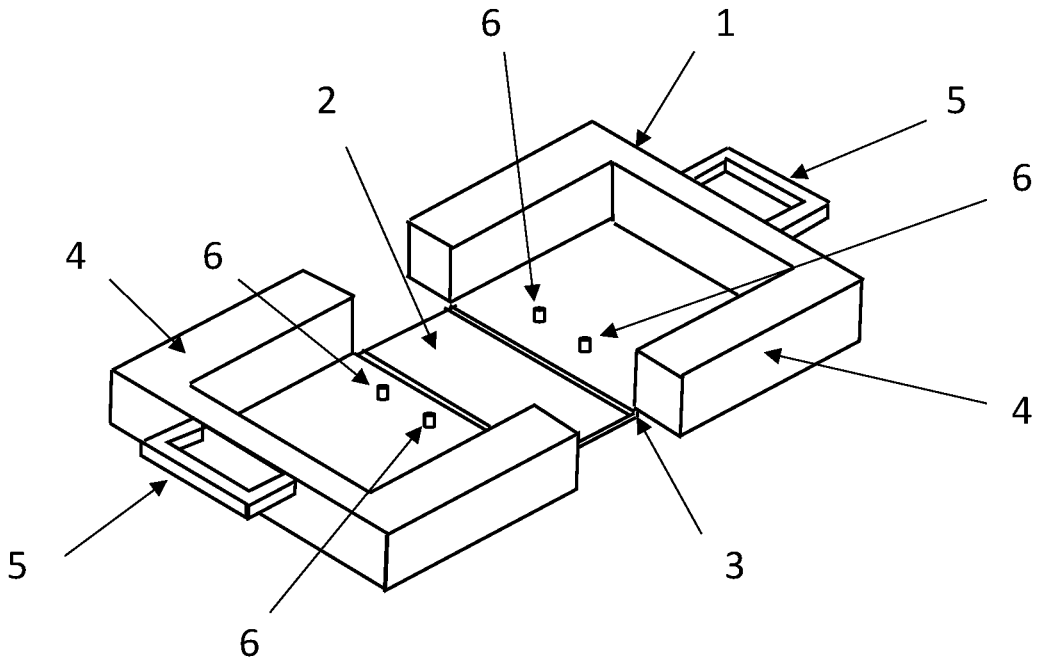
FIG. 5 is a perspective view of the base support of the retractable cylindrical safety marker according to the present disclosure in the open position.
Figure 6:
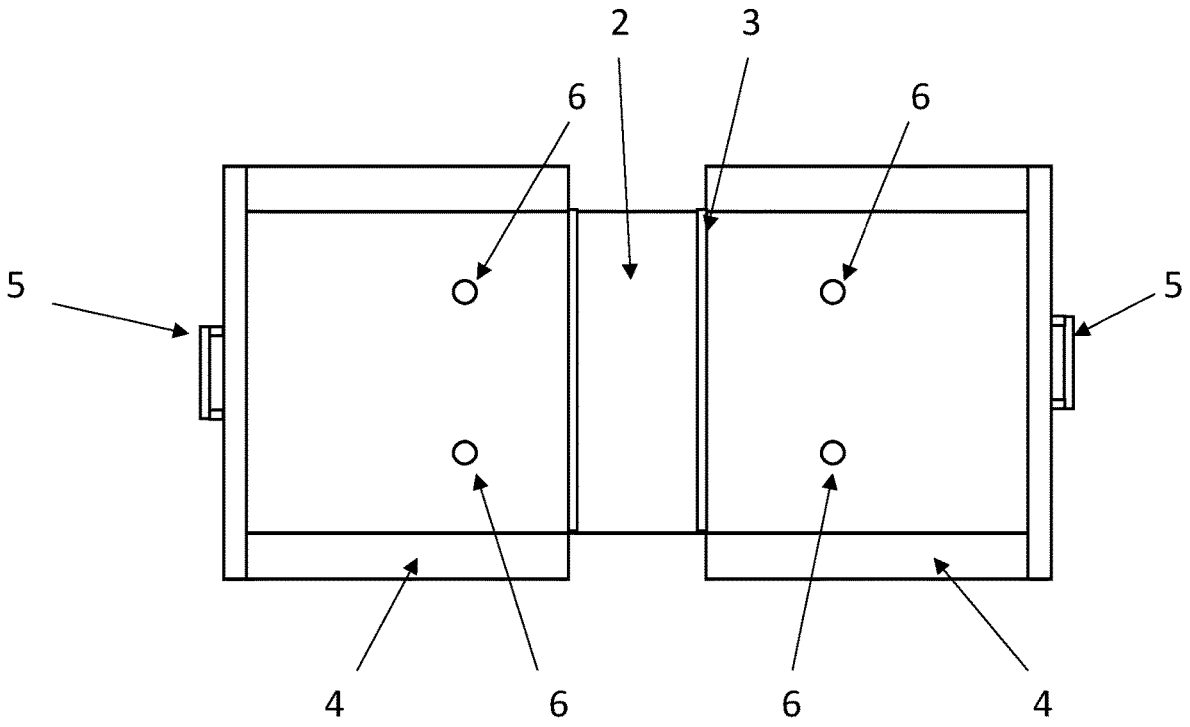
FIG. 6 is a top view of the base support of the retractable cylindrical safety marker according to the present disclosure in the open position.

FIG. 4 illustrates the retractable cylindrical safety marker 100 according to the present application in the closed and retracted position, illustrating the base support 1 and the handles 5 located on the end sections 4 of the base support L Referring to FIG. 5, the base support 1 in the open position illustrating the end sections 4 of the base support 1, handle 5, middle section 2 of the base support 1, a pair of flexible member 3 that adjoins the end sections 4 of the base support 1 with the middle section 2 of the base support 1. In addition, the end sections 4 of the base support 1 each have at least one protruding member 6 that are perpendicular to the end pieces 4 of the base support 1 when the retractable cylindrical safety marker 100 is in the open position. FIG. 6 is a top view of the base support 1 in the open position illustrating the middle support 2, flexible member 3 adjoining the middle section 2 to the end sections 4, end sections 4, handle 5 affixed to each end section 4 and a series of protruding members 6 that are affixed to the end sections 4.

In the retractable cylindrical safety marker 100 according to the present disclosure the upper riser 10 includes to two protrusions 13 located along the top edge of the upper riser 10 that are designed to serve as a handle when deploying the vertical risers from the retracted to extended position. Although two protrusions 13 are illustrated, one or more may be included to serve as the handle.

The upper riser 10 includes one or more tabs 12 on the lower portion of the upper riser 10 located on the outside surface of the cylindrical shape.

The upper riser includes a series of hinges 11 that extend the entire vertical length of the upper riser 10. This permits the upper riser 10 to collapse into its folded or flattened configuration.

The series of middle risers 20 includes a series of hinges 21 that extend the entire vertical length of the middle riser 20. This permits each middle riser 20 to collapse into its folded or flattened configuration.

The middle risers 20, in a manner similar to the upper riser 10, each contains one or more tabs 22 on the lower portion of the riser located on the outside surface of the cylindrical shape. The series of middle risers 20 also contain one or more vertical slots 23 located on the interior surface of the cylindrical shape. These slots 23 run the vertical length of the interior surface. The purpose of the vertical slot 23 on the middle riser 20 is to receive the tab 12 of the upper riser 10 in a manner that secures the two elements together, while permitting the two risers to move relative to each other in a longitudinal direction. This combination also allows the upper riser 10 to be extended in a vertical direction by pulling upward on the protrusions 13 on the upper portion of the upper riser 10.

The retractable cylindrical safety marker 100 according to the present disclosure also teaches that more than one middle riser 20 can be utilized. Each successive middle riser 20 is slightly larger in diameter than a proceeding one, allowing multiple middle risers 20 to be connected with the smaller diameter riser that fit inside the successive larger diameter middle riser 20.

The retractable cylindrical safety marker 100 according to the present disclosure also contains a lower riser 30 with a series of hinges 31 that extend the entire vertical length of the individual riser component. The lower riser 30 contains a series of vertical slots 32 located on the interior surface of the cylindrical shape. These slots 32 run the vertical length of the surface. The purpose of the vertical slots 32 on the lower riser 30 is to receive the tabs 22 of the middle riser 20 in a manner that secures the two elements together. On each middle 20 and lower 30 riser the respective slot 23/32 has a cap 24/34 on its upper limit that prevents a successive riser from being pulled through each other when the retractable cylindrical safety marker 100 is fully extended. The lower riser 30 also contains a series of flexible connectors 33 that are designed to be affixed to the series of protruding tabs 6 on the two ends 4 of the base support 1.

Figure 7:
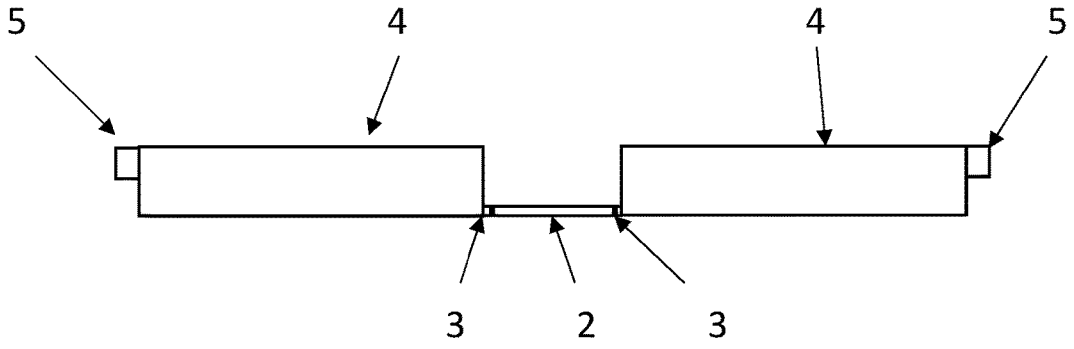
FIG. 7 is a side view of the base support of the retractable cylindrical safety marker according to the present disclosure in the open position.
Figure 8:
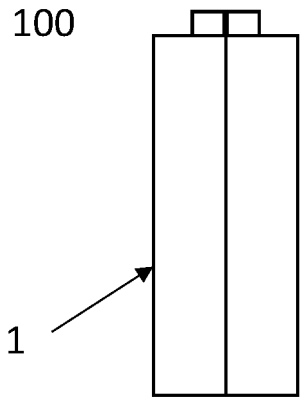
FIG. 8 is a side view of the base support of the retractable cylindrical safety marker according to the present disclosure in the closed position.
Figure 9:
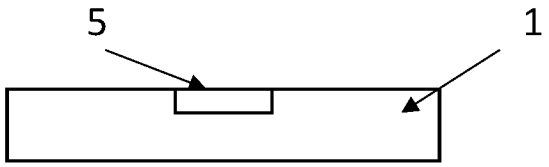
FIG. 9 is a front view of the base support of the retractable cylindrical safety marker according to the present disclosure in the open position.

FIG. 7 is a side view of the base support 1 in the open position illustrating the middle section 2, flexible member 3 adjoining the middle section 2 to the end section 4, end section 4, and the handle 5 affixed to the end section 4. FIG. 8 is a side view of the base support 1 in the closed position illustrating the locations of the handles 5. FIG. 9 is a front view of the base support 1 in the open position illustrating the location of the handles 5.

Figure 10:
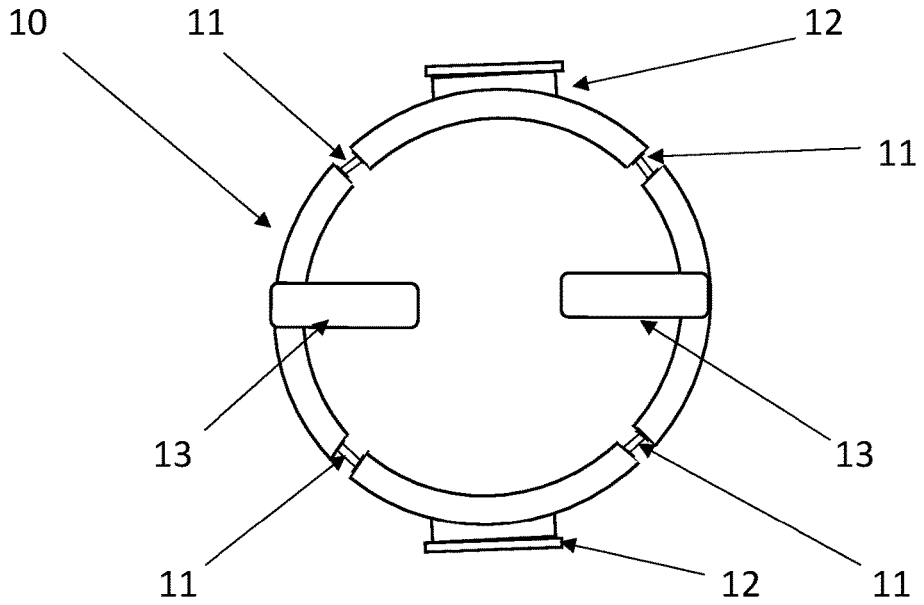
FIG. 10 is a top view of the upper riser of the retractable cylindrical safety marker according to the present disclosure.
Figure 11:
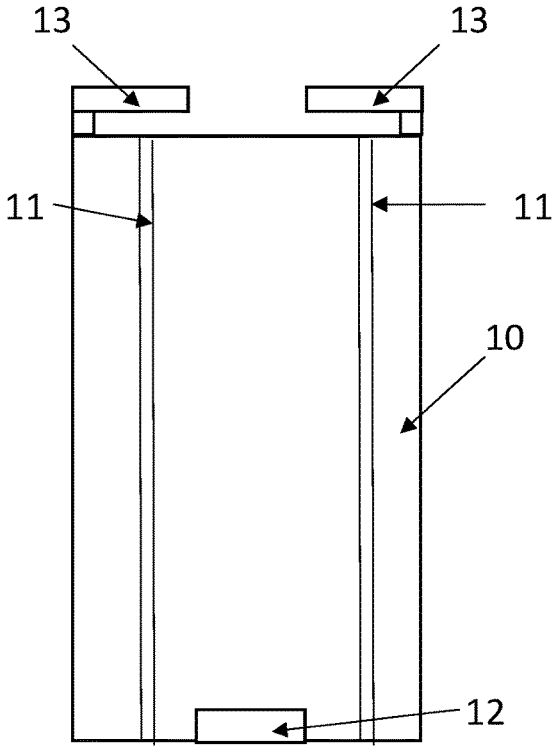
FIG. 11 is a front view of the upper riser of the retractable cylindrical safety marker according to the present disclosure.
Figure 12:
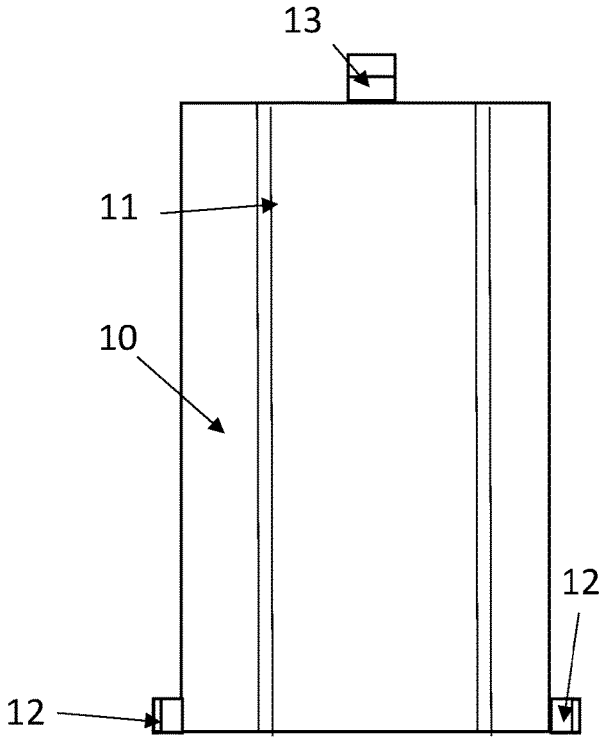
FIG. 12 is a side view of the upper riser of the retractable cylindrical safety marker according to the present disclosure.

FIG. 10 is a top view of the upper riser 10 illustrating the location of the upper riser flexible hinge 11, the tabs 12 and the upper handle 13. FIG. 11 is a front view of the upper riser 10 illustrating the location of the upper riser flexible hinge 11, the upper riser tab 12 and the upper handle 13. FIG. 12 is a front view of the upper riser 10 illustrating the location of the upper riser flexible hinge 11, the upper riser tab 12 and the upper handle 13.

Figure 13:
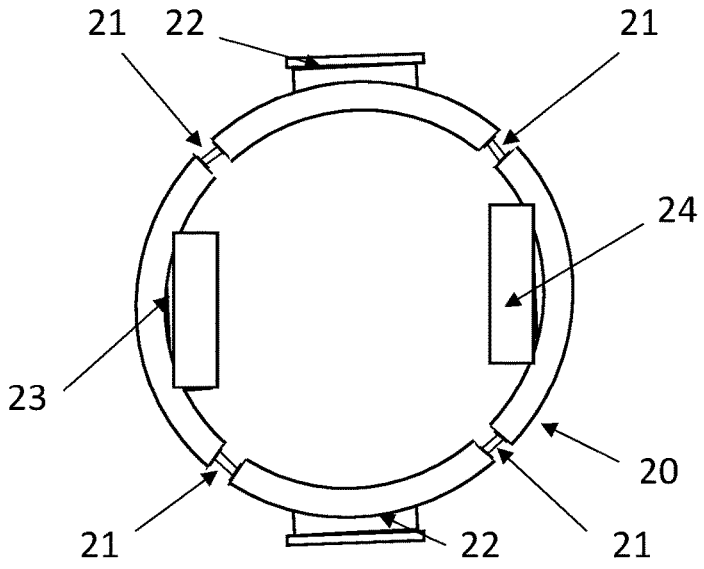
FIG. 13 is a top view of the middle riser of the retractable cylindrical safety marker according to the present disclosure.
Figure 14:
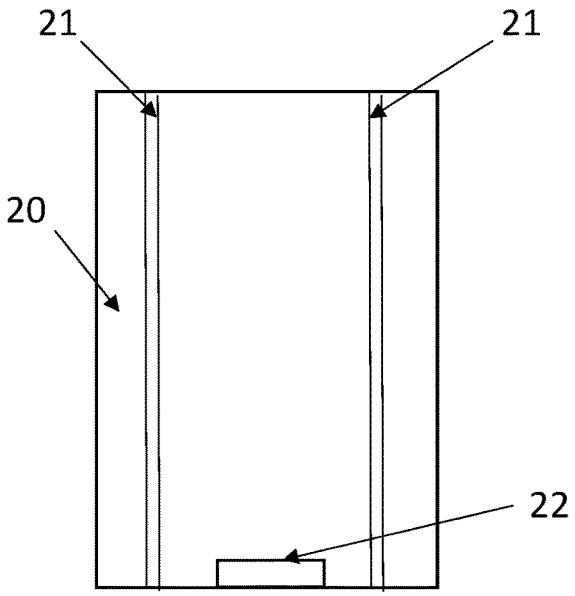
FIG. 14 is a front view of the middle riser of the retractable cylindrical safety marker according to the present disclosure.
Figure 15:
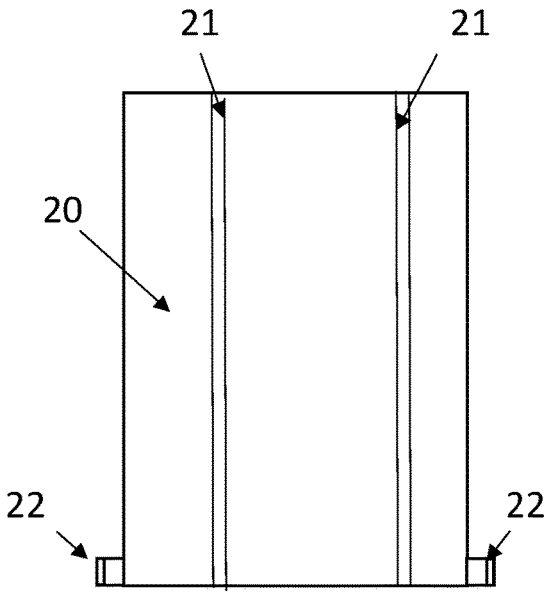
FIG. 15 is a side view of the middle riser of the retractable cylindrical safety marker according to the present disclosure.

FIG. 13 is a top view of a middle riser 20 illustrating the location of the middle riser flexible hinge 21, the middle riser tab 22, the middle riser slot 23 and a cap 24 on the slot 23 of the middle riser 20. FIG. 14 is a front view of the middle riser 20 illustrating the location of the middle riser flexible hinge 21 and the middle riser tab 22. FIG. 15 is a side view of the middle riser 20 illustrating the location of the middle riser flexible hinge 21 and the middle riser tab 22.

Figure 16:
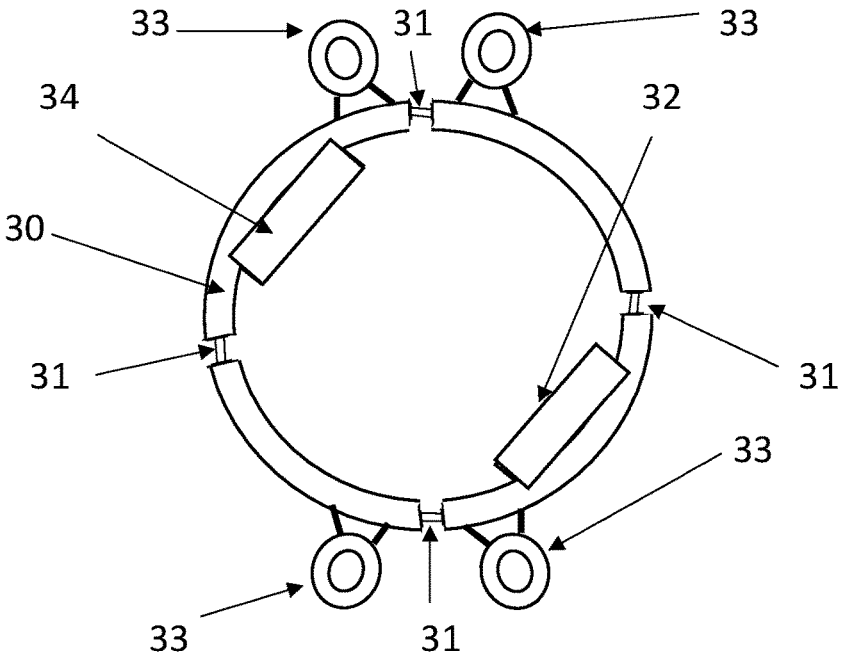
FIG. 16 is a top view of the lower riser of the retractable cylindrical safety marker according to the present disclosure.
Figure 17:
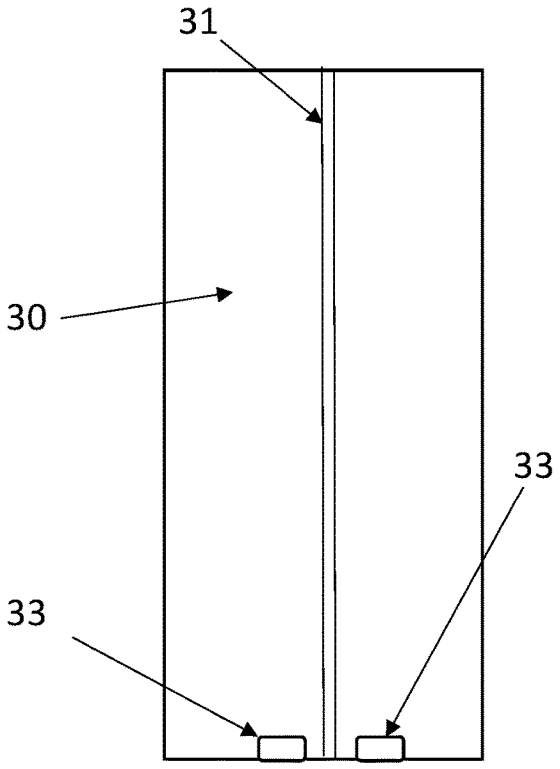
FIG. 17 is a front view of the lower riser of the retractable cylindrical safety marker according to the present disclosure.
Figure 18:
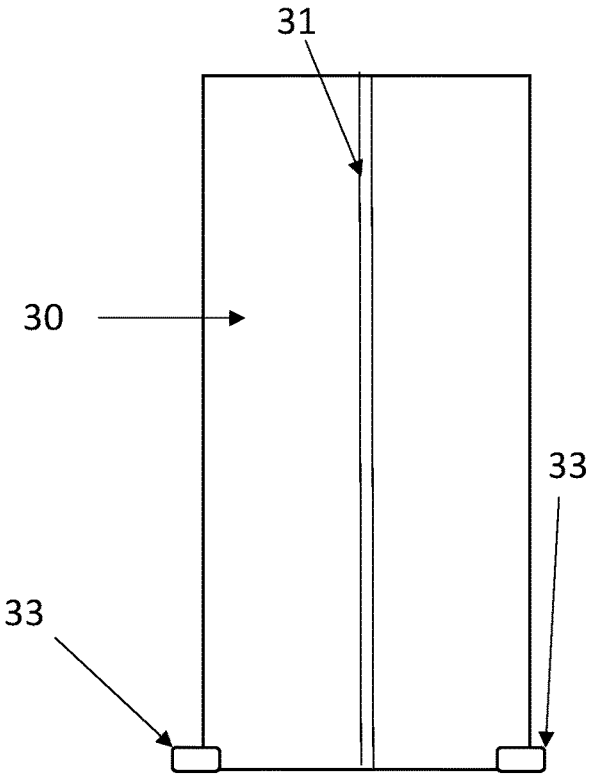
FIG. 18 is a side view of the lower riser of the retractable cylindrical safety marker according to the present disclosure.

FIG. 16 is a top view of the lower riser 30 illustrating the location of the lower riser flexible hinge 31, the lower riser slots 32, a cap 34 on the slot 32 of the lower riser 30, and the lower riser flexible connectors 33. FIG. 17 is a front view of the lower riser 30 illustrating the location of the lower riser flexible hinge 31 and the lower riser flexible connectors 33. FIG. 18 is a side view of the lower riser 30 illustrating the location of the lower riser flexible hinge 31 and the lower riser flexible connectors 33.

Figure 19:
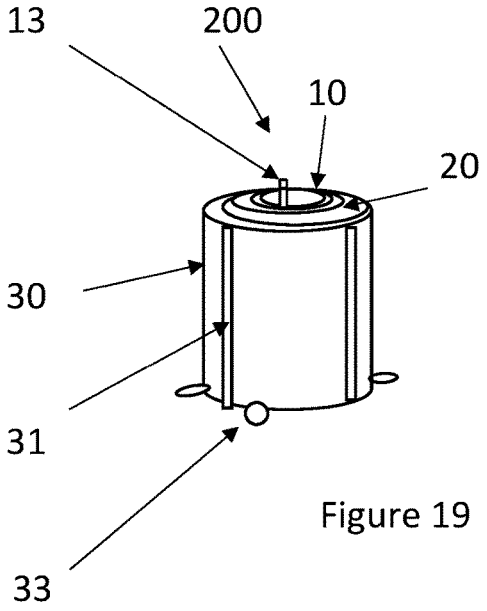
FIG. 19 is a perspective view of the vertical riser of the retractable cylindrical safety marker according to the present disclosure in the retracted position.
Figure 20:
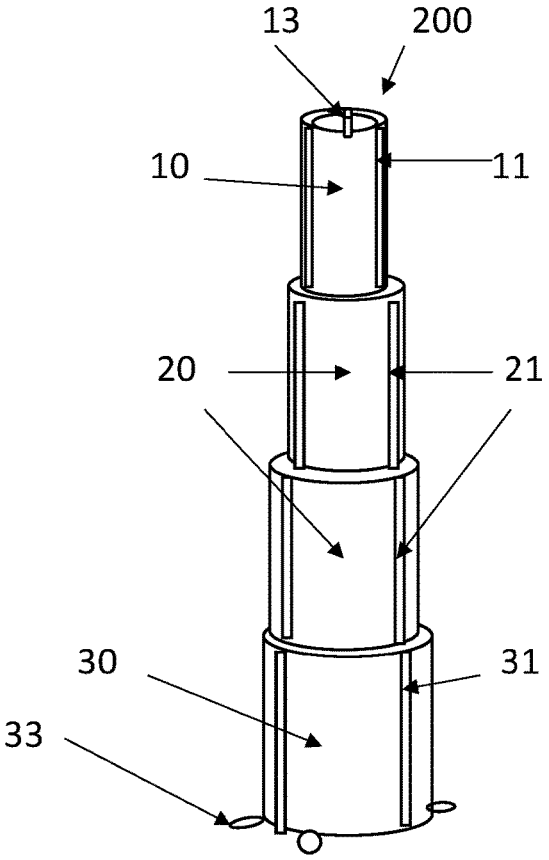
FIG. 20 is a perspective view of the vertical riser of the retractable cylindrical safety marker according to the present disclosure in the expanded position.

FIG. 19 is perspective view of the series of vertical risers 200 in the retracted position illustrating the locations of the upper riser 10, upper handle 13, middle riser 20, lower riser 30, the lower riser flexible hinge 31 and the lower riser flexible connectors 33. FIG. 20 is perspective view of the series of vertical risers 200 in the expanded position illustrating the locations of the upper riser 10, upper riser flexible hinge 11, upper handle 13, middle riser 20, middle riser flexible hinge 21, lower riser 30, the lower riser flexible hinge 31 and the lower riser flexible connectors 33.

Figure 21:
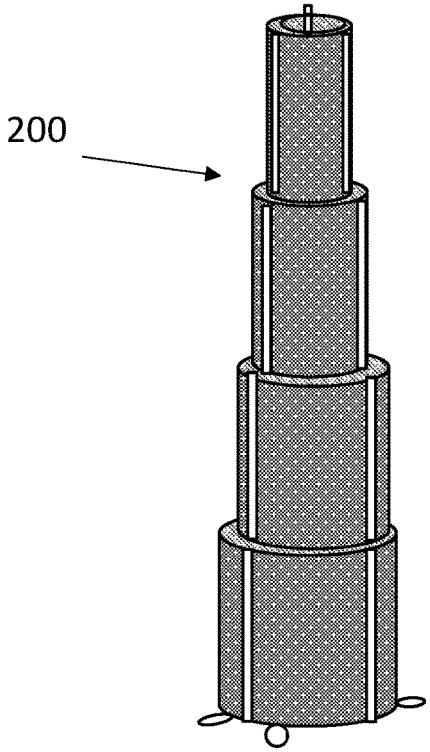
FIG. 21 is a perspective view of the vertical riser of the retractable cylindrical safety marker according to the present disclosure with air-flow holes in the expanded position.

FIG. 21 is perspective view of the series of vertical riser 200 in the extended configuration illustrating wherein the vertical risers contain air-flow holes. One or more of the vertical risers 10/20/30 can be perforated to permit wind to pass through the riser 10/20/30 to prevent the wind from providing undesired force on the vertical risers 10/20/30 and knock the retractable cylindrical safety marker 100 over.

Figure 22:
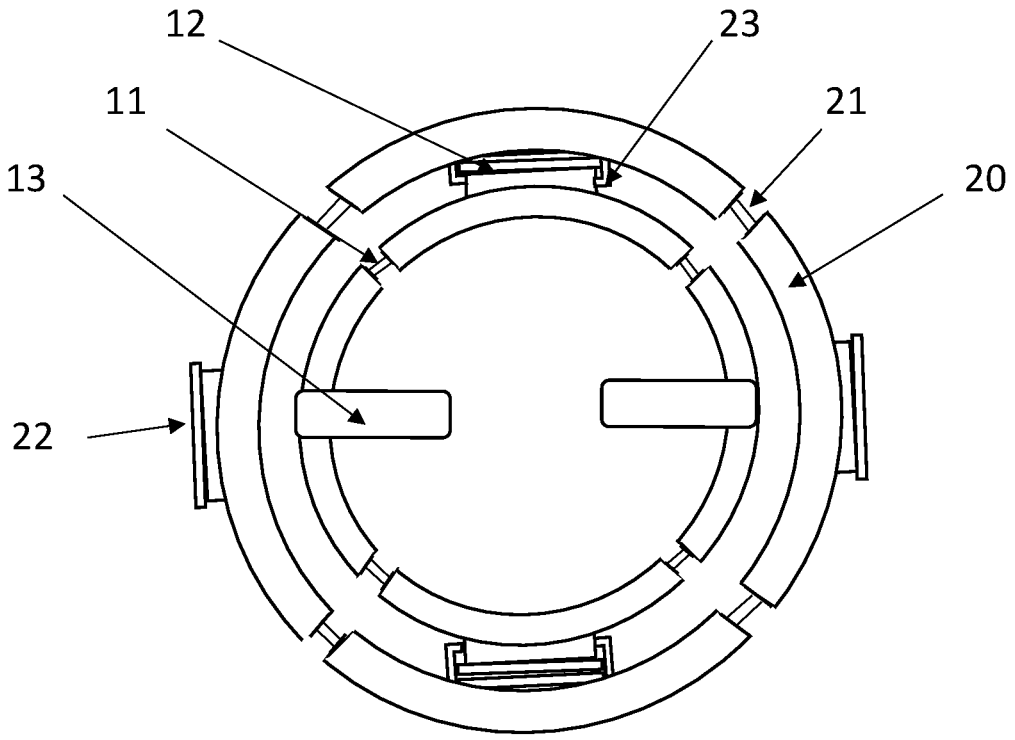
FIG. 22 is a top view of the lower riser and middle riser of the retractable cylindrical safety marker according to the present disclosure.
Figure 23:
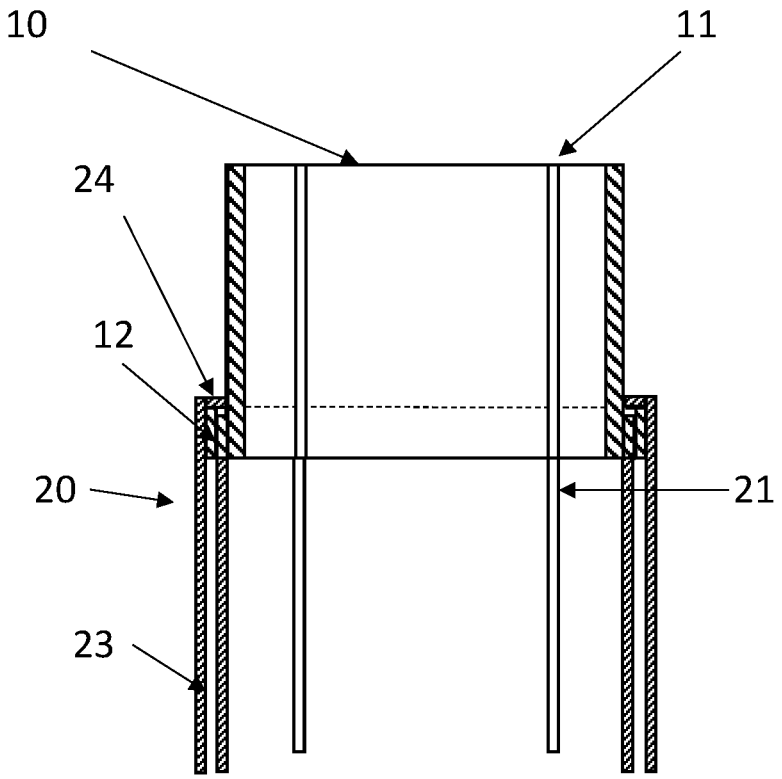
FIG. 23 is a cross-sectional view of the lower riser and middle riser of the retractable cylindrical safety marker according to the present disclosure in the expanded position.

FIG. 22 is a top view illustrating the connection between the upper riser 10 and the middle riser 20 when the vertical riser of the retractable cylindrical safety marker 100 is assembled. As illustrated the connection is made by inserting the tab of the lower riser 12 into the slot of the middle riser 23. This view illustrates where the tab of the lower riser 12 is in inserted into the slot of the middle riser 23 taken below the position the cap 24. FIG. 23 is a cross-sectional view illustrating the connection between the upper riser 10 and the middle riser 20 when the vertical riser of the retractable cylindrical safety marker 100 is assembled. As illustrated the connection is made by inserting the tab 12 of the middle riser 20 into the slot 23 of the middle riser 20. When extended the middle riser 20 is held in place by the cap 24 on the slot 23 of the middle riser 20 that prevents the upper riser 10 from being pulled through the middle riser 20. Various shapes and sizes for the tab 12 and slot 23 configurations are contemplated.

Figure 24:
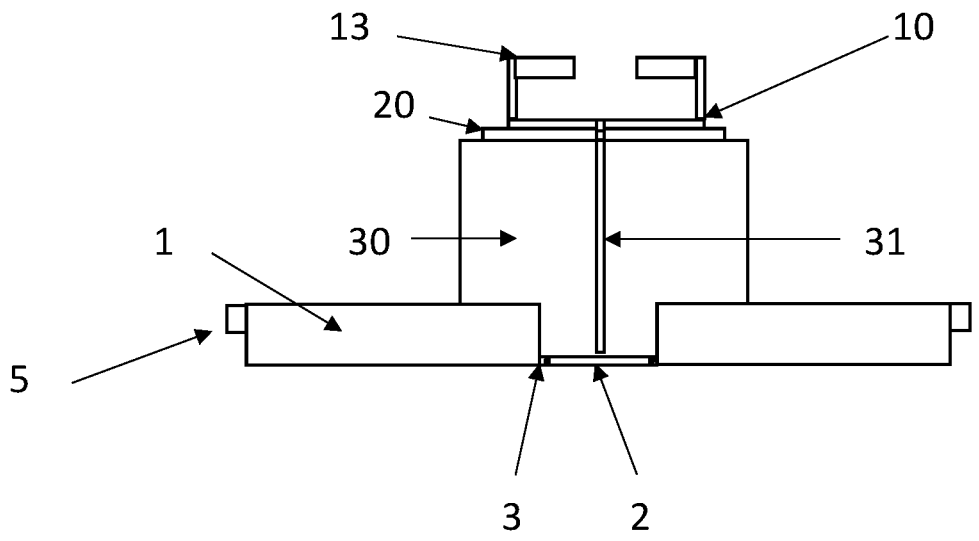
FIG. 24 is a side view of the retractable cylindrical safety marker according to the present disclosure in the open and retracted position.
Figure 25:
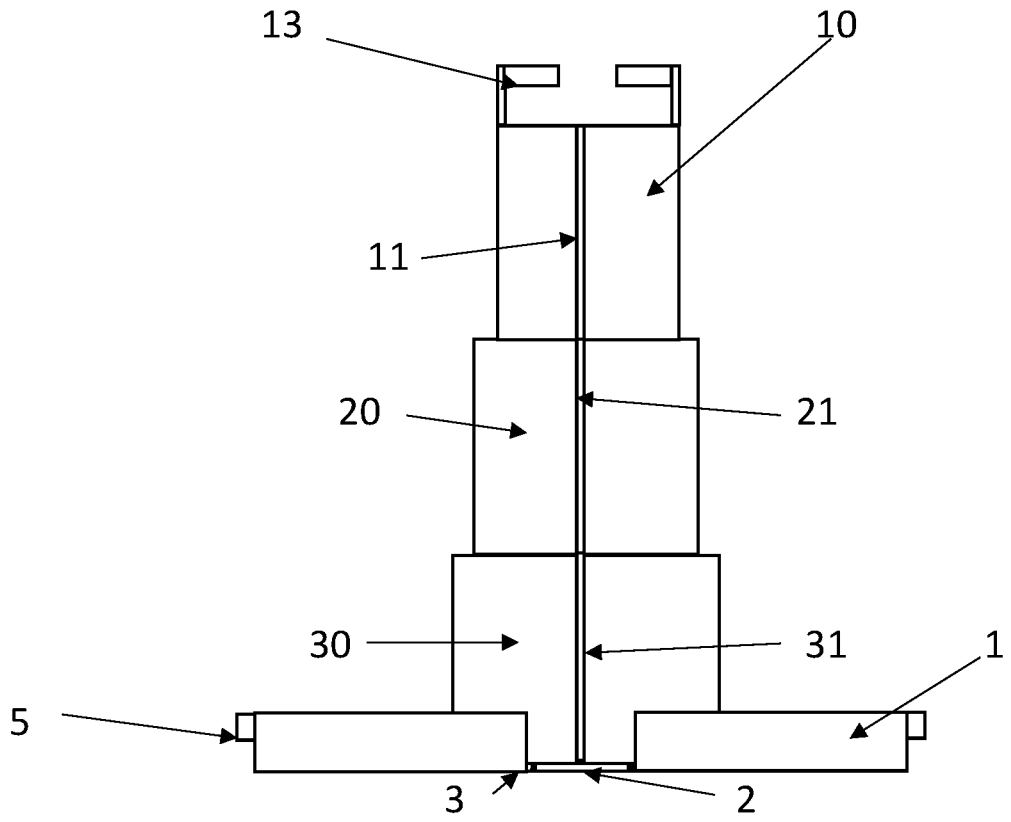
FIG. 25 is a front view of the retractable cylindrical safety marker according to the present disclosure in the open and expanded position.

FIG. 24 is a side view of the retractable cylindrical safety marker according to the present application in the open and retracted position illustrating the upper riser 10, upper handle 13, middle riser 20, lower riser 30, lower riser flexible hinge 31, the base support 1, the middle section 2 of the base support 1, the flexible member 3 adjoining the middle section 2 to the end section 4 and the handle 5 on the end section 4 of the base support 1. FIG. 25 is a side view of the retractable cylindrical safety marker according to the present application in the open and extended position illustrating the upper riser 10, upper handle 13, middle riser 20, lower riser (30, lower riser flexible hinge 31, the base support 1, the middle section 2 of the base support 1, the flexible member 3 adjoining the middle section 2 to the end section 4 and the handle 5 on the end section 4 of the base support 1.

FIG. 26 is a top view of the upper riser 10 of the retractable cylindrical safety marker 100 when in a collapsed or flattened position according to the present disclosure illustrating the location of the upper riser flexible hinge 11, the tabs 12 and the upper handle 13. FIG. 27 is a top view of the middle riser 20 of the retractable cylindrical safety marker 100 when in a collapsed or flattened position according to the present disclosure illustrating the location of the middle riser flexible hinge 21, the middle riser tab 22 the middle riser slot 23 and a cap 24 on the slot 23 of the middle riser 20. FIG. 28 is a top view of the lower riser 30 of the retractable cylindrical safety marker 100 when in a collapsed or flattened position according to the present disclosure illustrating the location of the lower riser flexible hinge 31, the lower riser slots 32, a cap 34 on the slot 32 of the lower riser 30, and the lower riser flexible connectors 33.

As illustrated in FIGS. 26-28, each riser 10/20/30 is shown in its flattened configuration. When the lower riser flexible connectors 33 are attached to the tabs 6 and the base is in its closed configuration, the risers 10/20/30 are forced into their flattened configuration as shown in FIGS. 26-28. The hinges 11/21/31 provide the flexibility to each respective riser 10/20/30 to move between the flattened and expanded configurations.

To deploy the retractable cylindrical safety marker, the user simply rotates the end sections 4 of the base support 1 about the middle section 2 of the base support 1 into an opened and a locked position perpendicular to the series of vertical risers 200. This expands the risers into their expanded configurations the tabs 6 exert a pulling force on the connectors 33. After the base support 1 is in the open position, the user lifts the upper handle 13, wherein the series of middle 20 and upper 10 risers are lifted into an extended and locked position produced by friction between the tabs and their respective slot. The retractable cylindrical safety marker is now ready for use.

The flexible hinges 11/21/31 are configured such to permit the riser 200 to move from its flattened configuration to its expanded configuration. When the end sections 4 are folded up about the middle section 2, the end sections 4 provide a flattening force on the riser 200, which in turn causes the riser 200 to enter its flattened configuration. When the end sections 4 are folder out from the middle section 2, a pulling force is exerted on the tabs 6 and connectors 33, which in turn causes the riser 200 to enter its expanded configuration.

In addition, reflective decals may be affixed to the vertical risers to correspond with traffic control device standards. The actual number of vertical risers employed depends on the application.

In comparing the retractable cylindrical safety marker employing cylindrical risers to the trapezoidal or cone shaped riser outlined in U.S. Pat. No. 7,571,693, the retractable cylindrical safety marker employees significantly less pieces to accomplish full deployment primarily the removal of the need for a retractable arm with upper linkage. In addition, the introduction of the series of vertical protruding tabs on the base support ends along with series of the flexible connectors on the lower riser eliminates the need for the lower linkages and ball-in-socket type method of affixing the vertical risers to the base support thereby improving the manufacturing and assembly process.

While the design outlined in U.S. Pat. No. 7,751,693 is an effective means of using cone or trapezoidal shaped riser, these shapes would not be appropriate for the retractable cylindrical safety marker 100. In a cone, trapezoidal of any riser shape that has tapered vertical edge, when the vertical riser is collapsed the taper exists between the collapsed pieces. This taper precludes the use of the exterior tabs and interior slots on the lower, middle, and upper risers as taught in the present application as the sliding action described above would not function as designed. As taught in U.S. Pat. No. 7,751,693 the tapered edges of the vertical risers are effectively held in place by the overlap of the material between successive risers when the retractable arm is lifted into the open position. The retractable cylindrical safety marker 100 eliminates the need for a retractable arm and associated upper linkage.

The retractable cylindrical safety marker has been designed for easy placement during emergency situations. The retractable cylindrical safety marker according to the present application offers an improvement over previous designs in required storage space, the lack of any locking mechanism, the ability to use lower cost reflective decals and is totally self-contained without requiring any assembly prior to implementation.

The retractable cylindrical safety marker is designed to provide motorists with advance warning of disabled vehicles and/or work zone areas. The device has been designed to withstand reasonable winds through the use of a base support with two end sections and a middle section, and a series of retractable vertical cylindrical risers. Each retractable vertical cylindrical riser is designed to interlock with successive vertical cylindrical risers when assembled through a series of tabs and slots on the interior and exterior of the individual vertical cylindrical risers, an extrusion on the slots of the vertical cylindrical risers that prohibit the successive risers from being pulled through each other. This allows for the series of vertical cylindrical risers to easily expand to height consistent with traffic engineering design standards when in operation and then compact when it is in storage.

The base support is designed not only to provide the necessary structural stability but to also open and close about the retractable vertical cylindrical risers thus providing for additional compactness.

The vertical cylindrical risers are designed with flexible hinges so that they may store flat and expand to a cylindrical shape when the base supports are rotated to an open position, accomplished by the plurality of connections between the lower vertical cylindrical riser and the base.

While the invention has been shown and described with reference to certain preferred embodiments thereof, it will be understood by those skilled in the art that various changes in form and details may be made within without departing from the spirit and scope of the invention. Consequently, the scope of the invention should not be limited to the embodiments, but should be defined by the claims and equivalents thereof.

What is claimed is:

1. A retractable cylindrical safety marker, comprising:

a base, comprising:

a middle section defining an upper planar surface and two opposing edges;

a first end section rotatably attached at an end to one of the opposing edges of the middle section; and a second end section rotatably attached at an end to the other of the opposing edges of the middle section, wherein the base has a closed configuration when the end sections are folded near to the middle section, and the base has an opened configuration when the end sections are folded away from the middle section, and a vertical riser, comprising:

a lower riser having a lower end attached to the first end section and the second end section, the lower riser having a slot extending along its interior surface in the longitudinal direction; and an upper riser positioned within the lower riser, the upper riser having a tab positioned on an outer surface thereof, the tab being mateable with the slot and configured to permit the tab to translate along the slot, wherein the risers are moveable perpendicular to a longitudinal axis of the vertical riser between a flattened configuration and an expanded configuration, and the risers are moveable along the longitudinal axis of the vertical riser between a retracted configuration and an extended configuration and in the extended configuration, are locked in position by friction between the tab and the slot.

2. The retractable cylindrical safety marker of claim 1, further comprising:

a first handle attached to an outer end of the first end section, the outer end opposite the end attached to the middle section; and a second handle attached to an outer end of the second end section, the outer end opposite the end attached to the middle section.

3. The retractable cylindrical safety marker of claim 1, wherein the lower and the upper risers are riser is composed of a perforated material to provide airflow therethrough.

4. The retractable cylindrical safety marker of claim 1, wherein the upper riser includes a handle attached to its uppermost surface.

5. The retractable cylindrical safety marker of claim 1, wherein each riser has a cross-sectional shape of one of a circle, oval, square, diamond, or combination thereof.

6. The retractable safety marker of claim 1, further comprising:

a slot cap positioned on an upper end of the slot and configured to prevent the tab from exiting the upper end of the slot.

7. The retractable safety marker of claim 1, wherein the slot extends along the interior surface of the lower riser only in the longitudinal direction.

8. The retractable safety marker of claim 1, wherein each said riser comprises a series of circumferentially-arranged flexible hinges extending along the entire longitudinal length thereof, and allowing said respective riser to collapse into folded or flattened condition.

9. The retractable safety marker of claim 1, further comprising:

at least one middle riser positioned between the lower riser and the upper riser, each of the at least one middle riser having a tab positioned on an outer surface thereof and a slot extending along its interior surface in the longitudinal direction, the tab matable with the slot of an adjacent riser and configured to permit the tab to translate along the slot, and the slot mateable with the tab of an adjacent riser and configured to permit the tab to translate along the slot.

10. The retractable safety marker of claim 9, wherein the respective tabs and slots of all said risers are circumferentially staggered with respect to one another.

11. The retractable safety marker of claim 1, wherein:

the lower riser includes a second slot extending along its interior surface in the longitudinal direction on a side of the lower riser opposite the slot, and the upper riser includes a second tab being mateable with the second slot and configured to permit the second tab to translate along the second slot.

12. The retractable safety marker of claim 11, comprising at least one intermediate riser having a pair of respective slots and tabs, with said respective tabs and slots of all said risers being circumferentially staggered with respect to one another.

13. A retractable safety marker, comprising:

a case having two side components that are positionable between an opened position and a closed position, each side component having a riser point of connection; and a vertical riser positioned within the case, comprising:

a lower riser having a lower end attachable to the riser point of connection on each side component of the case, the lower riser having a slot extending along its interior surface in the longitudinal direction; and an upper riser positioned within the lower riser, the upper riser having a tab positioned on an outer surface thereof, the tab being mateable with the slot and configured to permit the tab to translate along the slot, wherein the risers are moveable perpendicular to a longitudinal axis of the vertical riser between a flattened configuration when the outer case is closed and an expanded configuration when the outer case is opened, and the risers are moveable along the longitudinal axis of the vertical riser between a retracted configuration and an extended configuration and in the extended configuration, are locked in position by friction between the tab and the respective slot.

14. The retractable safety marker of claim 13, further comprising a first handle attached to an outer surface of the case.

15. The retractable safety marker of claim 13, wherein the lower and the upper riser is composed of a perforated material to provide airflow therethrough.

16. The retractable safety marker of claim 13, wherein the upper riser includes a handle attached to its uppermost surface.

17. The retractable safety marker of claim 13, wherein each riser has a cross-sectional shape of one of a circle, oval, square, diamond, or combination thereof.

18. The retractable safety marker of claim 13, further comprising:

at least one middle riser positioned between the lower riser and the upper riser, each of the at least one middle riser having a tab positioned on an outer surface thereof and a slot extending along its interior surface in the longitudinal direction, the tab matable with the slot of an adjacent riser and configured to permit the tab to translate along the slot, and the slot mateable with the tab of an adjacent riser and configured to permit the tab to translate along the slot.

19. A retractable safety marker, comprising:

a lower portion comprised of a flat bottom section:

two end pieces each end piece having a bottom with no top, two short sides and a long side, the short sides of the first end piece foldable at a first position about the middle piece of the base support and a second end piece foldable at a second position about the middle piece;

a plurality of collapsible hollow vertical cylindrical risers compromised of at least two collapsible vertical risers that fit within each other and are connected to each other through a series of tabs and slots to allow for vertical motion between the successive vertical risers, an extrusion on the slots of the vertical risers that prohibit the successive risers from being pulled through each other where each vertical riser having a collapsed position and an expanded position;

a lower riser of the at least two collapsible hollow vertical risers having a plurality of rotatable connections between the lower riser of the at least two collapsible hollow vertical risers and the first and second end section of the base support; and an upper riser of the at least two collapsible hollow vertical risers being extendable from the lower riser of the at least two collapsible hollow vertical risers, wherein the two ends of the base support are in an unfolded open position, the at least two collapsible hollow vertical risers are maintained in the expanded position due to the pulling force of the two ends of the base support on the lower riser of the at least two collapsible hollow vertical risers through the connections and locked in position by friction between the respective tabs and slots, and when the end sections of the base support are in the folded closed position, the at least two collapsible hollow vertical risers are maintained in the collapsed position due to the pushing force of the end section of the base support on the at least two hollow vertical risers.

20. The retractable safety marker of claim 19, wherein the upper riser of the at least two vertical risers has a handle affixed to its top.

21. The retractable safety marker of claim 19, wherein at least two of the collapsible hollow vertical risers are designed with air-flow holes.

22. A retractable safety marker, comprising:

a lower portion comprised of a flat bottom section;

a first and second base support, the first base support foldable at a first edge of the lower portion and the second base support foldable at a second edge of the lower portion, the second edge being opposite the first edge;

three vertical risers that fit within each other, a lower riser, an upper riser being extendable from the lower riser, and a middle riser extendable from the lower riser and with the upper riser extendable from the middle riser, each of said vertical risers having a collapsed state and an expanded state, creating a volume area defined by said of vertical risers;

contained on the exterior surface of the upper vertical riser are a series of tabs, contained on the exterior surface of the middle vertical risers are a series of tabs, contained on the interior surface of the middle vertical riser are a series of slots, the combination of the tabs on the upper vertical riser and slots on the middle vertical riser allow the pieces to be joined in a manner that allows vertical movement between the two risers, contained on the interior surface of the lower vertical riser are a series of slots, the combination of the tabs on the middle vertical riser and slots on the lower vertical riser allow the pieces to be joined in a manner that allows vertical movement between the two risers, in the extended configuration, the respective risers are locked in position by friction between the respective tabs and slots, an extrusion provided on the slots of the vertical risers that prohibits the successive risers from being pulled through each other, the lower vertical riser contains a series of flexible connectors that allows the lower vertical riser to be affixed to the end of base supports;

wherein the first and second ends of base supports are foldable about the of vertical risers and enclose the vertical risers when the plurality vertical risers are extended and in the collapsed state.

23. The retractable safety marker of claim 22, wherein the upper riser of the vertical risers has a handle affixed to its top.

24. The retractable safety marker of claim 22, wherein at least two of the vertical risers are designed with air-flow holes.

* * * * *